US010753180B2

(12) United States Patent
San Martin et al.

(10) Patent No.: US 10,753,180 B2
(45) Date of Patent: Aug. 25, 2020

(54) POWERING DOWNHOLE COMPONENTS IN SUBSURFACE FORMATIONS BEHIND CASING

(71) Applicant: Halliburton Energy Services, Inc., Houston, TX (US)

(72) Inventors: Luis E. San Martin, Houston, TX (US); Ahmed E. Fouda, Houston, TX (US); Burkay Donderici, Pittsford, NY (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/321,878

(22) PCT Filed: Sep. 19, 2016

(86) PCT No.: PCT/US2016/052466
§ 371 (c)(1),
(2) Date: Jan. 30, 2019

(87) PCT Pub. No.: WO2018/052450
PCT Pub. Date: Mar. 22, 2018

(65) Prior Publication Data

US 2019/0162052 A1 May 30, 2019

(51) Int. Cl.
*E21B 41/00* (2006.01)
*E21B 47/01* (2012.01)

(52) U.S. Cl.
CPC ..... *E21B 41/0085* (2013.01); *E21B 47/01* (2013.01)

(58) Field of Classification Search
None
See application file for complete search history.

(56) References Cited

U.S. PATENT DOCUMENTS 2,708,261 A * 5/1955 Thompson ..... G01V 3/22 324/357
2,891,215 A * 6/1959 Fearon ..... G01V 3/24 324/368

(Continued)

FOREIGN PATENT DOCUMENTS

WO WO 2001/004461 A1 1/2001

OTHER PUBLICATIONS

International Search Report and The Written Opinion, dated May 26, 2017, PCT/US2016/052466, 16 pages, ISA/KR.

*Primary Examiner* — Chico A Foxx
(74) *Attorney, Agent, or Firm* — Haynes and Boone, LLP

(57) ABSTRACT

A system and method according to which a downhole component positioned behind a casing is powered, the casing extending within an oil and gas wellbore that traverses a subterranean formation. Powering the downhole component may include inducing an electrical current to flow in the casing; permitting the electrical current to flow out of the casing to create a first potential difference between a first point and a second point spaced therefrom, the first and second points being located behind the casing; utilizing the first potential difference to store electrical power; and supplying the stored electrical power to the downhole component positioned behind the casing to thereby power the downhole component. The system may include a power source in electrical communication with the casing; a power harvester positioned behind the casing and in electrical communication with the downhole component; and a current return unit in electrical communication with the power source.

20 Claims, 6 Drawing Sheets

(56) References Cited

U.S. PATENT DOCUMENTS

| | | | | |
|---|---|---|---|---|
| 3,123,808 | A * | 3/1964 | Ward | G11C 11/06 365/144 |
| 5,543,715 | A * | 8/1996 | Singer | G01V 3/24 324/368 |
| 6,515,592 | B1 | 2/2003 | Babour et al. | |
| 6,679,332 | B2 | 1/2004 | Vinegar et al. | |
| 8,009,059 | B2 | 8/2011 | Huang et al. | |
| 8,056,623 | B2 * | 11/2011 | Schmitt | E21B 47/121 166/250.01 |
| 2003/0058127 | A1 | 3/2003 | Babour et al. | |
| 2005/0046589 | A1 * | 3/2005 | Wisler | E21B 17/003 340/854.6 |
| 2009/0038793 | A1 | 2/2009 | Schmitt et al. | |
| 2011/0005746 | A1 * | 1/2011 | Schmitt | E21B 47/121 166/250.01 |
| 2011/0140702 | A1 * | 6/2011 | Bloemenkamp | E21B 49/00 324/355 |
| 2012/0326723 | A1 * | 12/2012 | Bloemenkamp | G01V 3/24 324/356 |
| 2013/0248169 | A1 | 9/2013 | Swanson et al. | |
| 2014/0320301 | A1 | 10/2014 | Hudson | |
| 2015/0369947 | A1 * | 12/2015 | James | G01V 3/20 324/324 |

* cited by examiner

POWERING DOWNHOLE COMPONENTS IN SUBSURFACE FORMATIONS BEHIND CASING

PRIORITY

The present application is a U.S. National Stage patent application of International Patent Application No. PCT/US2016/052466, filed on Sep. 19, 2016, the benefit of which is claimed and the disclosure of which is incorporated herein by reference in its entirety.

TECHNICAL FIELD

The present disclosure relates generally to oil and gas operations and the equipment used therefor, and, more specifically, to a system and method to power downhole components in subsurface formations behind casing.

BACKGROUND

The placement of downhole components such as, for example, permanent sensors for the monitoring of oil and gas reservoirs can help optimize the resource extraction process. Since permanent sensors are often placed behind casing ("behind-casing sensors"), such behind-casing sensors may not be easily accessed once the well construction has been completed. Additionally, it is necessary to deliver electrical power to the behind-casing sensors over the operational life of the system, which could be on the order of years. Delivering electrical power to behind-casing sensors may require significant modification to the usual downhole hardware. Therefore, what is needed is a method or system that addresses one or more of these issues, and/or one or more other issues.

BRIEF DESCRIPTION OF THE DRAWINGS

Various embodiments of the present disclosure will be understood more fully from the detailed description given below and from the accompanying drawings of various embodiments of the disclosure. In the drawings, like reference numerals may indicate identical or functionally similar elements.

DETAILED DESCRIPTION

Figure 1:
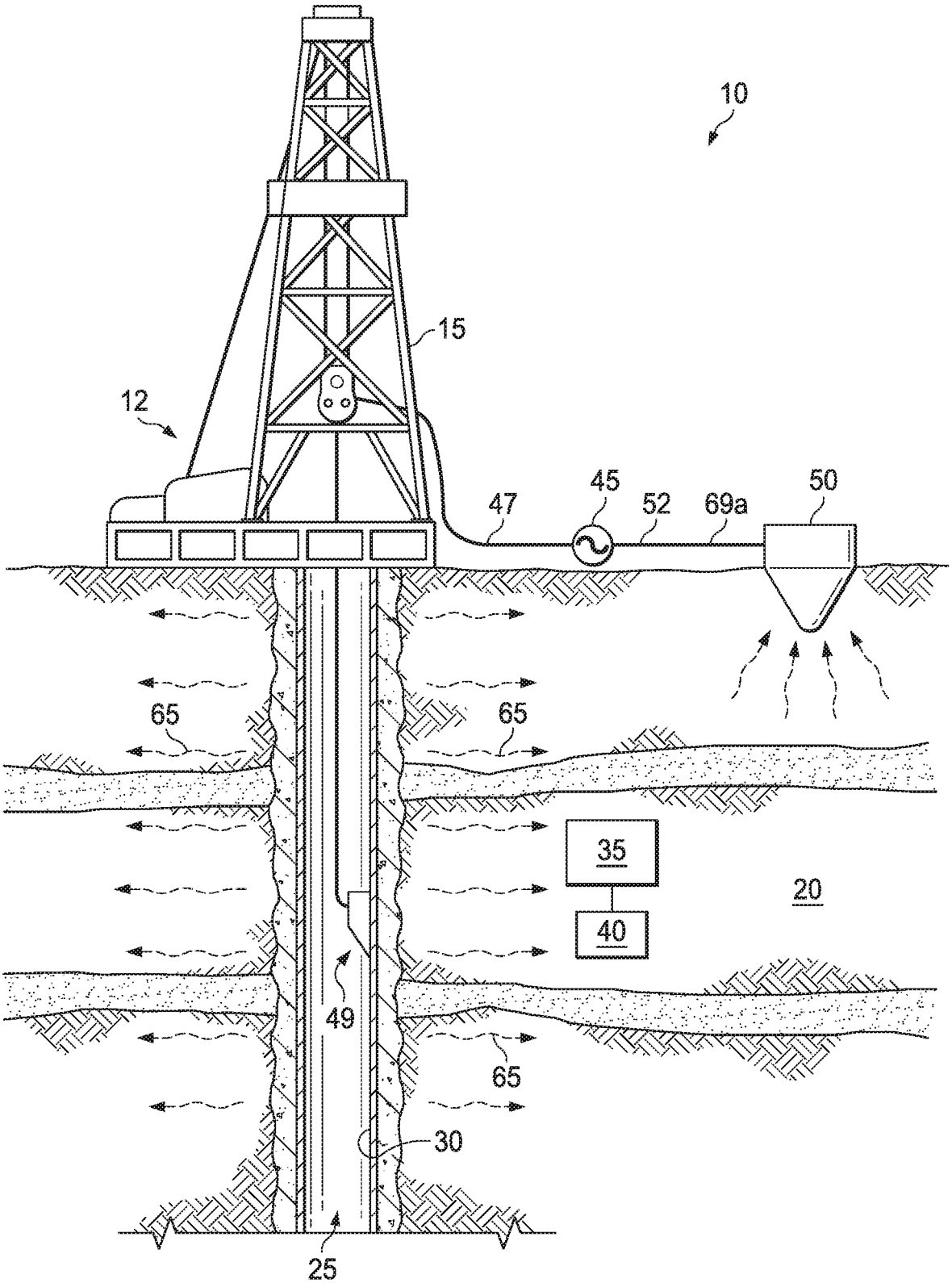
FIG. 1 is a schematic illustration of a system for powering a downhole component including a casing and at least one behind-casing sensor, according to an exemplary embodiment of the present disclosure.

Illustrative embodiments and related methods of the present disclosure are described below as they might be employed in a system and method for powering downhole components in subsurface formations behind casing. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The following disclosure may repeat reference numerals and/or letters in the various examples or figures. This repetition is for the purpose of simplicity and clarity and does not in itself dictate a relationship between the various embodiments and/or configurations discussed. Further, it should be understood that the use of spatially relative terms such as "above," "below," "upper," "lower," "upward," "downward," "uphole," "downhole," and the like are used in relation to the illustrative embodiments as they are depicted in the figures, the upward and downward directions being toward the top and bottom of the corresponding figure, respectively, and the uphole and downhole directions being toward the surface and toe of the well, respectively. Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Although a figure may depict a horizontal wellbore or a vertical wellbore, unless indicated otherwise, it should be understood that the apparatus according to the present disclosure is equally well suited for use in wellbores having other orientations including vertical wellbores, horizontal wellbores, slanted wellbores, multilateral wellbores, or the like. Further, unless otherwise noted, even though a figure may depict an onshore operation, it should be understood that the apparatus according to the present disclosure is equally well suited for use in offshore operations. Finally, unless otherwise noted, even though a figure may depict a cased-hole wellbore, it should be understood that the apparatus according to the present disclosure is equally well suited for use in open-hole wellbore operations.

Referring initially to FIG. 1, a system for powering one or more downhole components is schematically illustrated and generally referred to by the reference numeral 10. The system 10 includes a well 12 having a wellhead installation 15 that is positioned over an oil and gas formation 20. One or more pressure control devices (not shown), such as, for example, blowout preventers (BOPs), derricks, and/or other equipment associated with drilling or producing a wellbore may be provided at the wellhead installation 15 or elsewhere in the system 10. A wellbore 25 extends downward from the wellhead installation 15 and traverses through the various earth strata, including the subterranean formation 20. At least a portion of the wellbore 25 includes a generally cylindrical casing 30 cemented therein. In an exemplary embodiment, the casing 30 is formed of a carbon steel material.

The system 10 further includes a downhole component 35 such as, for example, a sensor positioned behind, or exterior to, the casing 30. Although the downhole component 35 is schematically illustrated as being positioned near the middle of the wellbore 25, in other exemplary embodiments, the downhole component 35 is positioned along the length of the wellbore 25 at any desired location. Although, the downhole component 35 is schematically illustrated as being positioned within the formation 20, it should be understood, that in several exemplary embodiments the downhole component 35 is located in another position behind the casing. For example, in several exemplary embodiments, the downhole component 35 may be embedded within the wellbore 25 and/or within the cement behind the casing 30. In several exemplary embodiments, the downhole component 35 may be positioned within a lateral wellbore, within another wellbore extending within the formation 20, and/or the like. The downhole component 35 is used, in several exemplary embodiments, for collecting, storing, and transmitting to the surface, measurements and information about the surrounding formation 20. For example, the downhole component 35 may be, or include, a temperature sensor, pressure sensor, strain sensor, pH sensor, density sensor, viscosity sensor, chemical composition sensor, radioactive sensor, resistivity sensor, acoustic sensor, potential sensor, mechanical sensor, nuclear magnetic resonance logging sensor, and/or the like. In several exemplary embodiments, the system 10 includes a plurality of the downhole components 35 positioned within the formation 20 exterior to the casing 30 and used to collect, store, and/or transmit a variety of information and measurements about the surrounding formation 20.

A power harvester 40 is positioned behind the casing 30. The power harvester 40 is in electrical communication with the downhole component 35. Although the power harvester 40 is schematically illustrated as being positioned within the formation 20, it should be understood that, in several exemplary embodiments, the power harvester 40 is located elsewhere behind the casing. For example, the power harvester 40 may be embedded within the cement behind the casing 30. In several exemplary embodiments, the power harvester 40 may be positioned within a lateral wellbore, within another wellbore extending within the formation 20, and/or the like. In several exemplary embodiments, the system 10 includes a plurality of power harvesters 40 positioned behind the casing 30, each capable of delivering power to any number of downhole components 35 also positioned behind the casing 30. In an exemplary embodiment, the power harvester 40 is, or includes, a capacitor. In other exemplary embodiments, the power harvester 40 is, or includes, a rechargeable battery and/or other device or component capable of harvesting and storing electrical power. As will be discussed in further detail below, in an exemplary embodiment, the power harvester 40 is configured to harvest and store power for delivering power to the downhole component 35 as needed over an extended period of time. In some instances, the extended period of time could be the operational life of the system 10, which could be on the order of years.

A power source 45 is in electrical communication with the casing 30 via an electrode 47. In an exemplary embodiment, the power source 45 is adapted to supply AC electrical power to the system 10. In another exemplary embodiment, the power source 45 is adapted to supply DC electrical power to the system 10. In yet another exemplary embodiment the power source 45 is adapted to supply both AC electrical power and DC electrical power to the system 10. Although the power source 45 is shown schematically at a distance from the well 12, the power source 45 may be located elsewhere such as, for example, at the well 12. The electrode 47 extends across the ground surface between the power source 45 and the well 12. The electrode 47 further extends into the interior of the casing 30 and operably engages the casing 30 on an interior surface at a current injection point 49 located at a desired distance below the surface.

A current return unit 50 is in electrical communication with the power source 45 via an electrode 52. The current return unit 50 is positioned at the ground surface and distant from the well 12. Although the current return unit 50 is schematically illustrated as a point located on the ground surface, in several exemplary embodiments, the current return unit 50 could be placed at another location such as, for example, another well located a sufficient distance from the well 12. The electrode 52 extends across the ground surface between the current return unit 50 and the power source 45. In an exemplary embodiment, each of the electrodes 47 and 52 may include one or more electrical conductors. In several exemplary embodiments, each of the electrodes 47 and 52 may be, or include, electrical cables, electrical wires, and/or the like.

Figure 2:
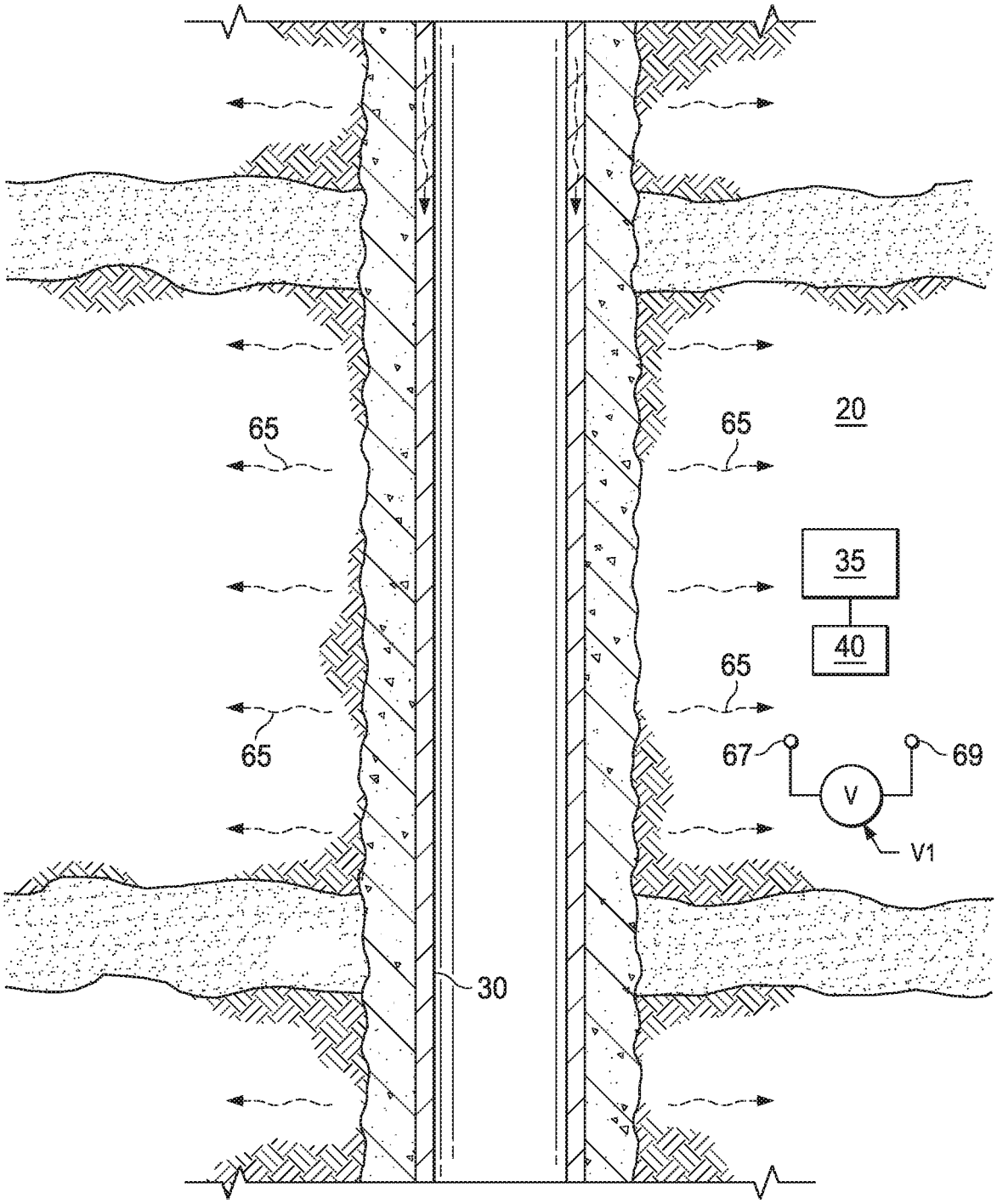
FIG. 2 is an enlarged schematic illustration of a portion of the system of FIG. 1, according to an exemplary embodiment of the present disclosure.

In operation, as illustrated in FIGS. 1 and 2, the power source 45 provides a potential difference between the current return unit 50 and the casing 30 to thereby induce an electrical current to flow through the electrode 47 and into the casing 30 at the current injection point 49. The electrical current flows axially within the casing 30 and away from the current injection point 49. As the electrically current flows axially, portions of the electrical current escape radially out of the casing 30, into the formation 20, and toward the current return unit 50. The escaping electrical current is depicted generally by radially extending arrows 65 as shown in FIGS. 1 and 2. The arrows 65 indicate schematically that the flow of electrical current into the formation 20 decreases as the axial distance from the current injection point 49 increases. In an exemplary embodiment, the downhole component 35 and the power harvester 40 are each positioned within the formation 20 in which the escaping electrical current flows.

As shown in FIG. 2, the electrical current escaping radially from the casing 30 and into the formation 20 creates a potential difference or voltage, schematically designated by the reference numeral V1, between radially-spaced points 67 and 69 in the formation 20 due to the electrical resistance of at least the formation 20. The radially-spaced points 67 and 69 are located behind the casing 30. Although a single potential difference V1 is schematically shown across the radially-spaced points 67 and 69, the electrical current creates any number of potential differences between various points located behind the casing 30 and within the formation 20, which points may be radially and/or axially spaced from one another. The power harvester 40 is positioned so that it utilizes the potential difference V1 within the formation 20 to extract and store the electrical power needed to provide power to the downhole component 35 during operation of the system 10. The power harvester 40 supplies electrical power to the downhole component 35. In several exemplary embodiments, the power harvester 40 is a permanently placed capacitor and is shorted and discharged when the downhole component 35 requires power to operate. In several exemplary embodiments, the power harvester 40 and downhole component 35 have input resistances that are much greater than the resistance of the surrounding formation 20 to avoid shorting out the developed potential difference V1 in the formation 20.

The electrical current flows through the formation 20 to the current return unit 50 and back to the power source 45 via the electrode 52. In several exemplary embodiments, the electrical current flows through a circuit 69*a* (FIG. 1) that includes at least the power source 45, the electrode 47, the casing 30, the formation 20, the current return unit 50, and the electrode 52.

In an exemplary embodiment, the casing 30 is a 20,000 ft. carbon steel casing embedded in the formation 20, the formation 20 having a resistivity of 20 Ωm. A one amp electrical current is injected into the middle of the casing 30 so that the potential difference induced across the radially-spaced points 67 and 69 is 0.5 mV when the radially-spaced points 67 and 69 are positioned at or near the current injection point 49 and are radially spaced by a distance of one inch. The resistance of a sector of the formation 20 one inch wide (in the azimuthal direction) and one foot long (reasonable dimensions for the power harvester 40 to be used) is 57Ω. In contrast, the power harvester 40 and/or the downhole component 35 have a significantly higher resistance such as, for example, 570Ω to avoid shorting out of the developed potential difference. Based on these parameters, the power harvester 40 collects power of approximately 0.5 nW, while the power consumed by the casing 30 is approximately 16 nW.

Figure 3:
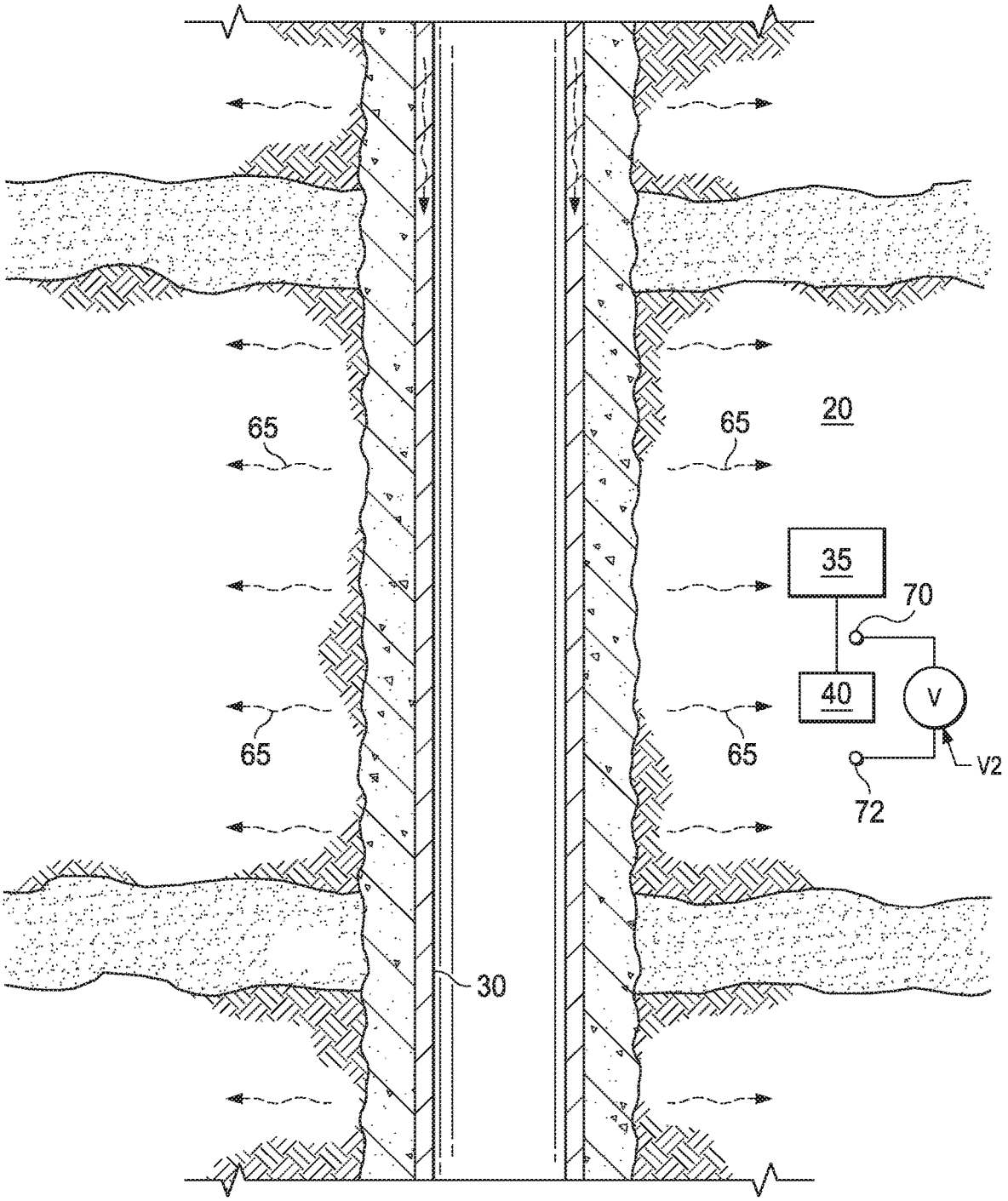
FIG. 3 is an enlarged schematic illustration of another exemplary embodiment of the present disclosure.

During operation, as illustrated in FIG. 3, with continuing reference to FIGS. 1 and 2, the electrical current flowing axially within the casing 30 and radially out of the casing 30 creates a potential difference or voltage, schematically designated by the reference numeral V2, between axially spaced points 70 and 72 in the formation 20. The potential difference V2 is created due to the resistance of at least the casing 30. The downhole component 35 is shifted upward in FIG. 3 to better illustrate the potential difference across the axially spaced points 70 and 72. Although the potential difference V2 is schematically shown across the axially spaced points 70 and 72 of the formation 20, the electrical current creates a multitude of potential differences between various points in the formation 20, such as, for example, the potential difference V1 shown in FIG. 2. The power harvester 40 is positioned so that it utilizes the potential difference V2 within the formation 20 to extract and store the electrical power needed to provide power to the downhole component 35 during operation of the system 10. The power harvester 40 supplies electrical power to the downhole component 35. In several exemplary embodiments, the power harvester 40 is a permanently placed capacitor that is shorted and discharged when the downhole component 35 requires power to operate. In several exemplary embodiments, the power harvester 40 and downhole component 35 have input resistances that are much greater than the resistance of the surrounding formation 20 to avoid shorting out the developed potential difference V2 in the formation 20.

In several exemplary embodiments, the potential difference V2 between the axially spaced points 70 and 72 in the formation 20 is less than the potential difference V1 (shown in FIG. 2) between the radially-spaced points 67 and 69 in the formation 20 because the resistance of the casing 30 is less than the resistance of the surrounding formation 20. Therefore, in several exemplary embodiments, to provide increased power, the power harvester 40 is configured to harvest power from potential differences that develop between radially-spaced points in the formation 20 rather than potential differences that develop between axially spaced points in the formation 20.

Figure 4:
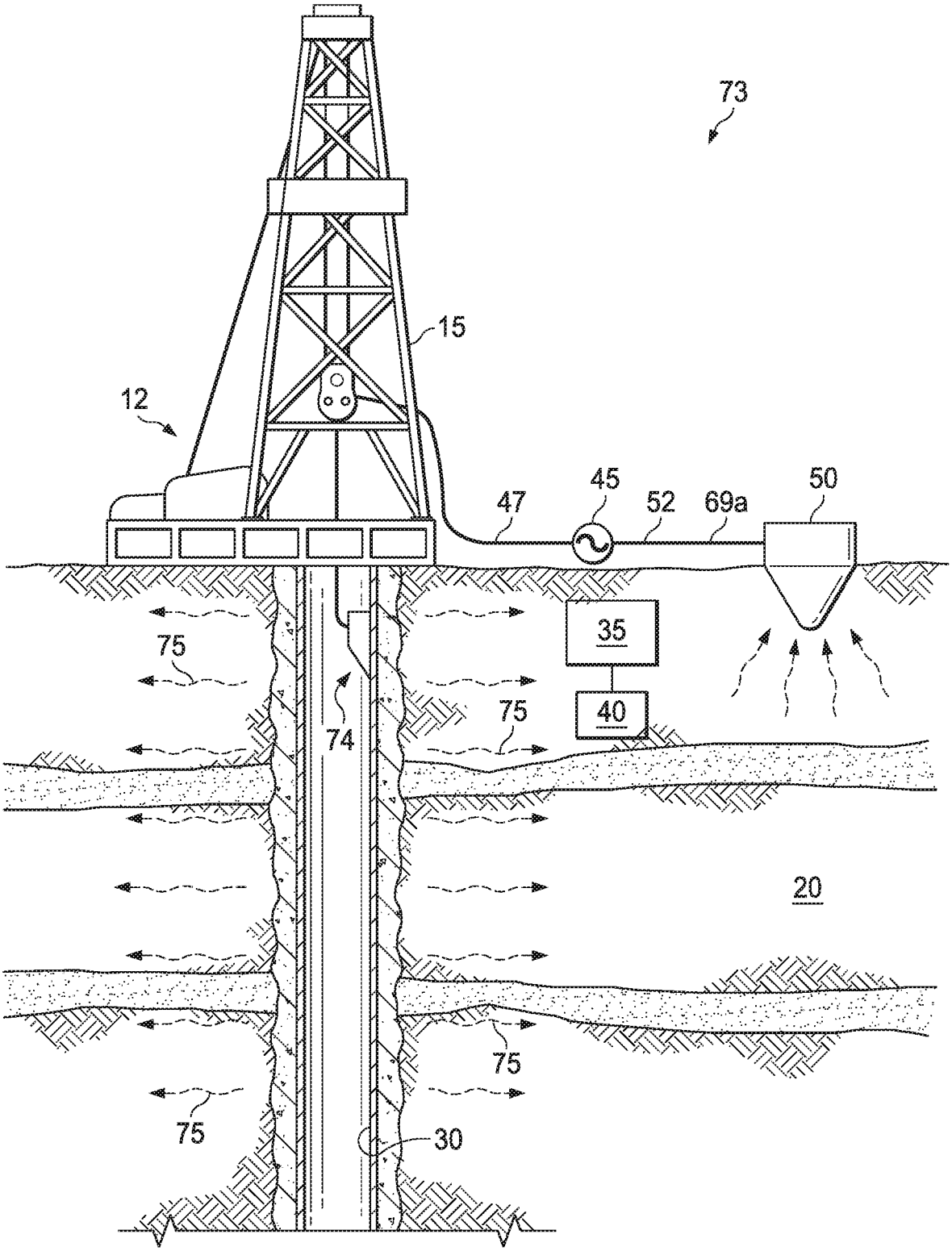
FIG. 4 is a schematic illustration of a system for powering a downhole component including a casing and at least one behind-casing sensor, according to an exemplary embodiment of the present disclosure.

Referring to FIG. 4, with continuing reference to FIGS. 1-3, an alternative embodiment of a system for powering one or more downhole components is shown and generally referred to by the reference numeral 73. The system 73 contains several of the same features and components of the system 10 of FIG. 1, which features and components are given the same reference numerals. The features and components of system 73 are substantially identical to the respective features and components of the system 10, except that the electrode 47 is operably engaged with the casing 30 at a current injection point 74 and the power harvester 40 and the downhole component 35 are shifted upward to a position closer to the current injection point 74. However, the power harvester 40 and the downhole component 35 may be located elsewhere behind the casing 30. The current injection point 74 is located proximate the ground surface.

The operation of the system 73 is substantially identical to the operation of the system 10, except that, because the current injection point 74 is proximate the ground surface, the flow of the electrical current that escapes the casing 30 (generally referred to by arrows 75) is largest proximate the ground surface and decreases progressively as the depth of the casing 30 increases.

In several exemplary embodiments, the system 73 is used to acquire information about the qualities and features of the formation 20 proximate the ground surface. Therefore, the downhole component 35 and the power harvester 40 are positioned near the ground surface behind the casing 30, as shown in FIG. 4. In several exemplary embodiments, to enable the power harvester 40 to harvest and store greater amounts of electrical power, the current injection point 74 is positioned proximate the ground surface, as shown in FIG. 4. When the current injection point 74 is located proximate the ground surface, greater amounts of electrical current flow radially out of the casing 30 proximate the surface (near the current injection point 74). The electrical current flowing from the casing 30 creates a potential difference proximate the ground surface from which the power harvester 40 is configured to harvest power. In several exemplary embodiments, depending on the positioning and power requirements of the downhole component 35, the current injection point 74 is repositioned so that the maximum electrical current escapes the casing 30 proximate the downhole component 35 and/or the power harvester 40.

In several exemplary embodiments, the amount of power harvested by the power harvester 40 or the efficiency of the power harvester 40 may be increased by a variety of means. For example, in several exemplary embodiments, the physical dimensions of the power harvester 40 may be increased to achieve greater power harvesting capabilities. In other exemplary embodiments, one or more portions of the casing 30 may be insulated to prevent electrical current from flowing out of the casing 30 into the surrounding formation 20. By insulating the casing 30, it is possible to control the segments of the casing 30 along which electrical current is permitted to flow radially into the surrounding formation 20. For example, a highly resistive cement or a casing paint may be used along one or more portions of the casing 30 (for example, at positions where the downhole components 35 are not located) to prevent the electrical current from escaping into the surrounding formation 20. By using an insulator such as highly resistive cement, casing paint, and/or the like, the electrical current is only allowed to escape the casing 30 into the formation 20 proximate the downhole components 35 and/or the power harvesters 40. In other exemplary embodiments, the use of highly resistive cement or casing paint along one or more portions of the wellbore 25 prevents electrical current from leaking out of shallow portions of the formation 20.

Each of the systems 10 and 73 enable the powering of one or more downhole components without substantial modification to conventional downhole hardware.

Figure 5:
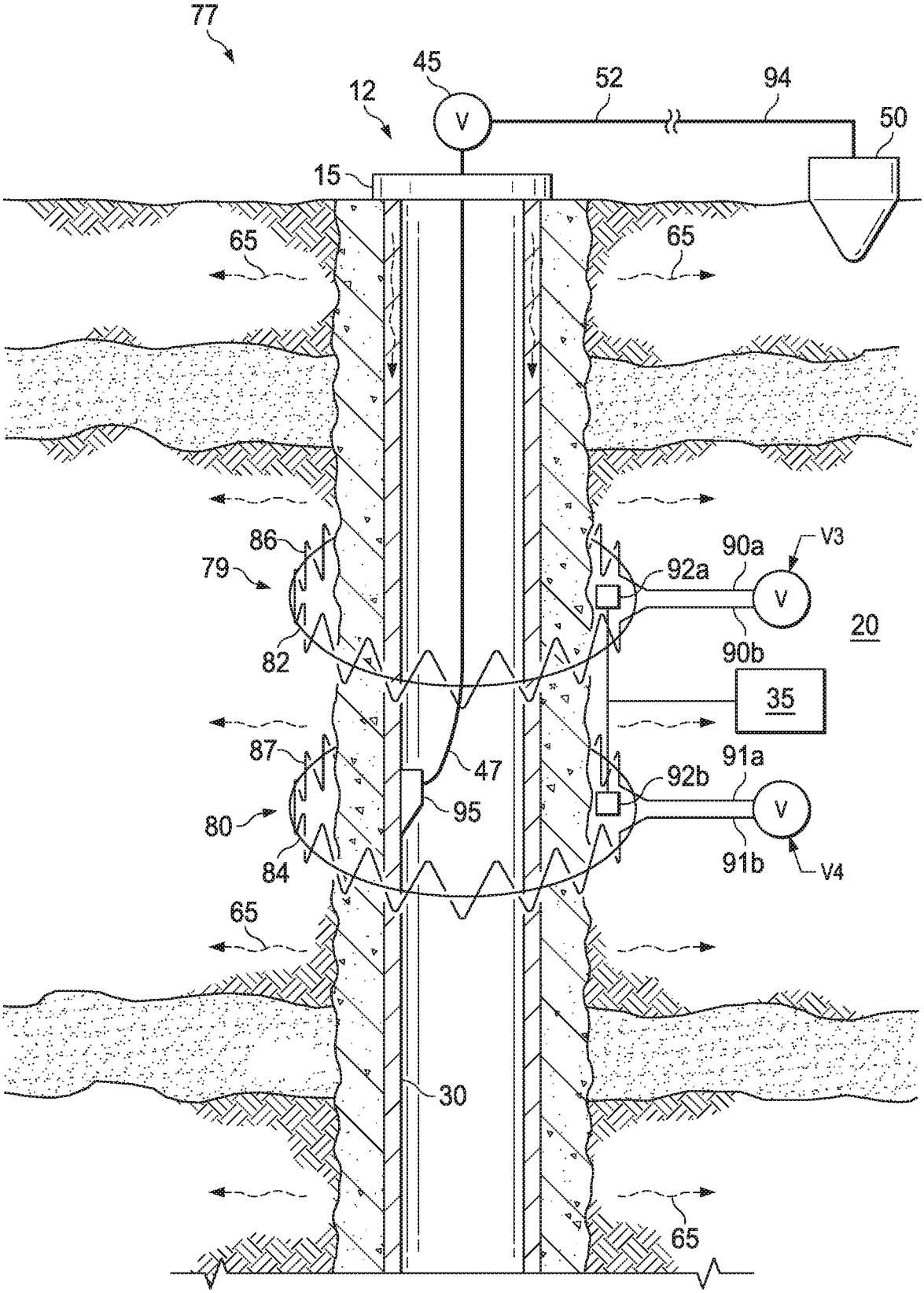
FIG. 5 is a schematic illustration of a system for powering a downhole component including at least one toroidal inductor, according to an exemplary embodiment of the present disclosure.

Referring to FIG. 5, with continuing reference to FIGS. 1, 2, and 3, an alternative embodiment of a system for powering one or more downhole components is shown and generally referred to by the reference numeral 77. The system 77 contains several of the features and components of the system 10 of FIG. 1, which features and components are given the same reference numerals. The system 77 further includes toroidal inductors or toroids 79 and 80. Although the toroids 79 and 80 and their corresponding components are illustrated and described herein as substantially identical, in several other exemplary embodiments, the toroids 79 and 80 and their respective features and components are not identical. For example, the toroids 79 and 80 may be formed of different materials.

The toroids 79 and 80 include generally circular ring-shaped magnetic cores 82 and 84, respectively. In several exemplary embodiments, the cores 82 and 84 are formed of a highly magnetic permeable material such as iron powder, ferrite, and/or other high magnetic permeability materials capable of supporting a magnetic field. Windings 86 and 87 are coiled around the cores 82 and 84, respectively. In several exemplary embodiments, the windings 86 and 87 are coiled around the cores 82 and 84 a different numbers of times. In several exemplary embodiments, the windings 86 and 87 are coiled around the cores 82 and 84, respectively, the same or substantially the same number of times. Terminals 90*a* and 90*b* are provided on the toroid 79 adjacent one another, thus defining a small gap therebetween. Likewise, terminals 91*a* and 91*b* are provided on the toroid 80 adjacent one another, thus defining a small gap therebetween.

The toroids 79 and 80 are installed during the formation of the well 12 and extend circumferentially about the exterior of the casing 30. Incorporating the toroids 79 and 80 into the system 77 at the time of the formation of the well 12 requires only minimal changes to the typical hardware and construction of the well 12. In several exemplary embodiments, the system 77 may include more than two toroids installed at the time of the formation of the well 12. In several exemplary embodiments, the toroids 79 and 80 may each be positioned at respective longitudinal distances along the length of the casing 30 and need not be disposed concentric to the casing 30.

The power source 45 is in electrical communication with the casing 30 via the electrode 47. The electrode 47 extends from the power source 45 into the interior of the casing 30 and operably engages the casing 30 on an interior surface at a current injection point 95. In an exemplary embodiment, the current injection point 95 is positioned approximately equidistant from each of the toroids 79 and 80 along the longitudinal length of the casing 30. The system 77 also includes power harvesters 92*a* and 92*b*. The power harvesters 92*a* and 92*b* are positioned within the respective interiors of the toroids 79 and 80. However, the power harvesters 92*a* and 92*b* may be located elsewhere in the formation 20, as long as the power harvesters 92*a* and 92*b* are still capable of harvesting power from the toroids 79 and 80. In several exemplary embodiments, instead of, or in addition to, the power harvesters 92*a* and 92*b*, the system 77 includes a plurality of power harvesters positioned at other locations behind the casing 30. Additionally, although the power harvesters 92*a* and 92*b* are described as being substantially identical, in several exemplary embodiments, the power harvesters 92*a* and 92*b* are not identical. For example, in an exemplary embodiment, the power harvester 92*a* is a permanently placed capacitor and the power harvester 92*b* is a rechargeable battery, or vice versa.

In several exemplary embodiments, the downhole component 35 is operably coupled to and in electrical communication with the power harvesters 92*a* and 92*b*. Operably coupling the downhole component 35 to the power harvesters 92*a* and 92*b* enables the downhole component 35 to receive electrical power from the power harvesters 92*a* and 92*b*. In several exemplary embodiments, the downhole component 35 is coupled to a plurality of power harvesters, such as, for example, the power harvesters 92*a* and 92*b*, to provide increased power to the downhole component 35. In several exemplary embodiments, the system 77 includes a plurality of downhole components 35, each operably connected to and/or in electrical communication with at least one of the power harvesters 92*a* and 92*b*.

In operation, as illustrated in FIG. 5, the toroids 79 and 80 are used to transfer power from the casing 30 to the power harvesters 92*a* and 92*b* through a process of electromagnetic induction. The process is initiated by using the power source 45 to provide AC electrical power to create a potential difference between the current return unit 50 and the casing 30. The potential difference induces a time-dependent electrical current, which flows into the casing 30 via the electrode 47, which is operably engaged with the casing 30 at the current injection point 95. The electrical current flows axially within the casing 30. In several exemplary embodiments, one or more portions of the casing 30 are insulated to prevent electrical current from flowing out of the casing 30 and into the surrounding formation 20 until after the electrical current has passed through the toroids 79 and 80. As a result, the electrical current induces a magnetic field around the casing 30 at the location of the toroids 79 and 80, thus producing a magnetic flux in each of the cores 82 and 84. The magnetic flux in the core 82 induces a potential difference or voltage between the terminals 90*a* and 90*b*, which voltage is generally referred to by the reference numeral V3. Similarly, the magnetic flux in the core 84 induces a potential difference or voltage between the terminals 91*a* and 91*b*, which voltage is generally referred to by the reference numeral V4. Using the voltages V3 and V4, electrical power is accumulated and, optionally, stored by the power harvesters 92*a* and 92*b*. The power harvesters 92*a* and 92*b* supply electrical power to the downhole component 35. The power delivered is dependent on the magnitude and frequency of the electrical current flowing within the casing 30. The electrical current flows through the formation 20 to the current return unit 50 and back to the power source 45 via the electrode 52. In several exemplary embodiments, the electrical current flows through a circuit 94 that includes at least the power source 45, the electrode 47, the casing 30, the formation 20, the current return unit 50, and the electrode 52.

In several exemplary embodiments, the voltages V3 and V4 generated by the toroids 79 and 80, respectively, are greater than the potential differences V1 and V2. Therefore, the power delivered to the power harvesters 92*a* and 92*b* (and thus the downhole component 35) from the voltages V3 and V4 is greater than the power delivered to the power harvester 40 from the voltages V1 and V2 in the embodiments of FIGS. 2 and 3. Accordingly, in several exemplary embodiments, at least one of the toroids 79 and 80 is installed during the formation of the well 12 to provide power to the downhole component 35, especially when the downhole component 35 requires increased power to monitor the formation 20.

Figure 6:
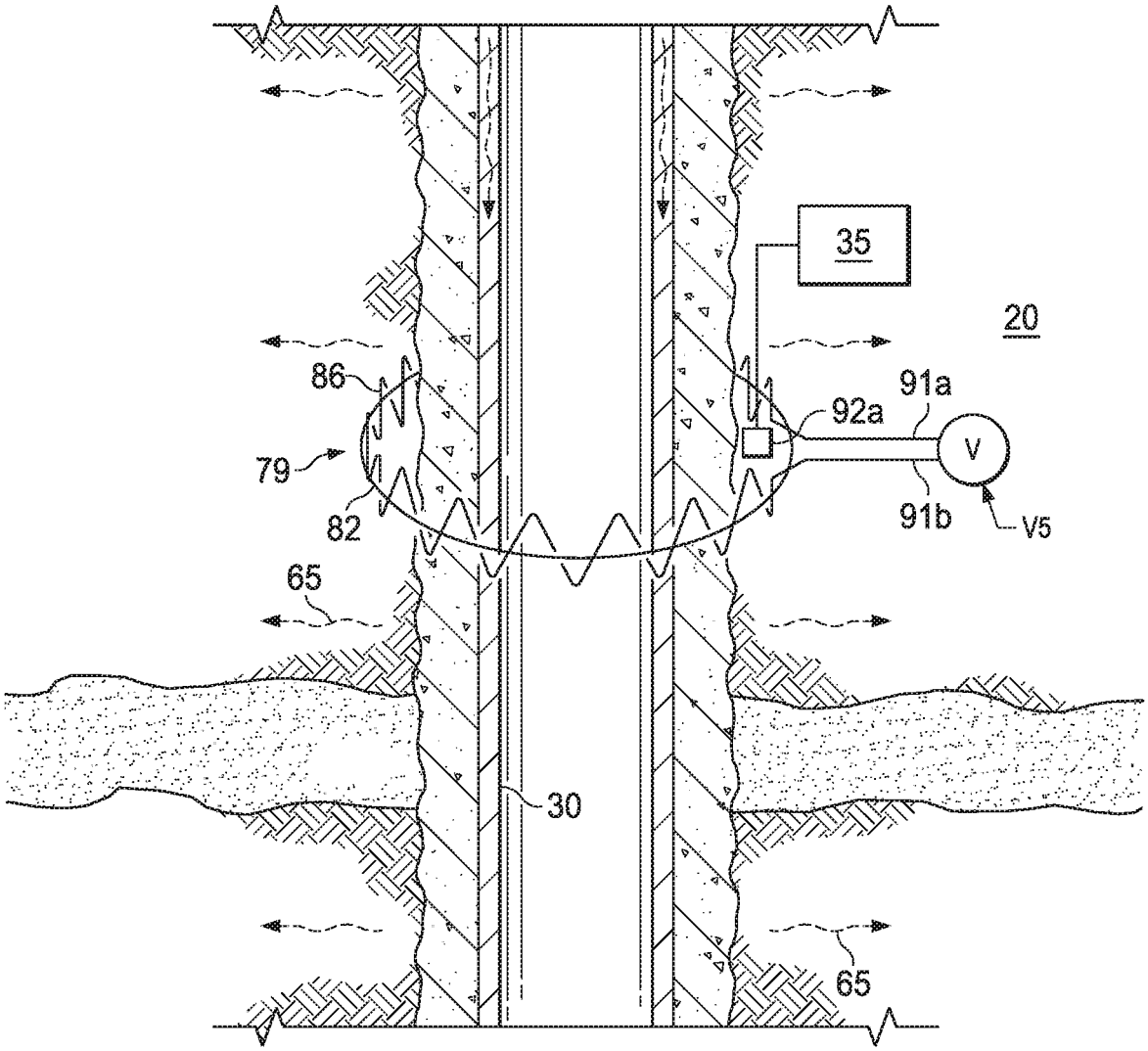
FIG. 6 is an enlarged schematic illustration of the system of FIG. 5, depicting a modification to the system, according to an exemplary embodiment of the present disclosure.

In an exemplary embodiment, as illustrated in FIG. 6 with continuing reference to FIGS. 1, 2, 3, and 5, the toroid 80 and the power harvester 92*b* are omitted from the system 77 so that only the toroid 79 and the power harvester 92*a* are utilized. In an exemplary embodiment, the current injection point 95 (not shown) is repositioned proximate the toroid 79 to ensure that a larger portion of the electrical current flows through the casing 30 at or near the position of the toroid 79. Greater amounts of power can be harvested and stored by the power harvester 92*a* when the current injection point 95 is located proximate the toroid 79 and the power harvester 92*a* is located proximate the terminals 90*a* and 90*b*, as shown in FIG. 6.

During operation, as illustrated in FIG. 6, a potential difference or voltage, generally referred to by the reference numeral V5, is created by electromagnetic induction across the toroid 79. The power harvester 92*a* utilizes the voltage V5 to extract and store electrical power and to supply electrical power to the downhole component 35. In several exemplary embodiments, the voltage V5 generated by the toroid 90 is greater than the potential differences V1 and V2. Therefore, the power delivered to the power harvester 92*a* (and thus the downhole component 35) from the voltage V5 is greater than the power delivered to the power harvester 40 from the voltages V1 and V2 in the embodiments of FIGS. 2 and 3. Accordingly, in several exemplary embodiments, at least one of the toroids 79 and 80 is installed during the formation of the well 12 to provide power to the downhole component 35, especially when the downhole component 35 requires increased power to monitor the formation 20.

In several exemplary embodiments, the voltage generated by each of the toroids 79 and 80 is proportional to $V=KACINf^2$, where A is the axial area of the toroid, C is the area of the cross section of the winding, I is the electrical current, N is the number of turns of the winding, f is the frequency, and K is a constant. The voltage generated by the toroids 79 and 80 may be increased by increasing any one of these parameters. For example, in several exemplary embodiments, the toroids 79 and 80 are elongated axially to increase the amount of voltage generated and thus the amount of power that the power harvesters 92*a* and 92*b* can harvest and store.

In several exemplary embodiments, instead of, or in addition to, the casing 30, multiple concentric casings (not shown) are cemented in the wellbore 25. The respective lengths of the multiple casings may vary significantly. For example, in an exemplary embodiment, the lengths of the respective casings are stepped down progressively from the innermost casing, which has the greatest length, to the outermost casing, which has the smallest length. As a result, the particular casing with which the formation 20 and/or the various earth strata has the closest proximity (and thus the least electrical resistance) varies depending on the depth of the wellbore 25. Consequently, in operation, the power source 45 is configured to induce an electrical current to flow through at least one of the multiple casings, depending on the depth of the wellbore 25 at which the potential differences V1-V5 are to be created. The location along the wellbore 25 at which the potential differences V1-V5 are desired will determine the particular casing with which the electrode 47 is operably engaged. In any event, the electrical current flows axially within the selected casing(s) and radially from the casing(s) in a manner similar to the embodiments shown and described above.

The present disclosure introduces a method of powering a downhole component positioned behind a casing, the casing extending within a wellbore that traverses a subterranean formation, the method including inducing an electrical current to flow in the casing; permitting the electrical current to flow out of the casing to create a first potential difference between a first point and a second point spaced therefrom, the first and second points being located behind the casing; utilizing the first potential difference to store electrical power; and supplying the stored electrical power to the downhole component positioned behind the casing to thereby power the downhole component. In an exemplary embodiment, the downhole component is positioned behind the casing and within the subterranean formation; the first and second points are located behind the casing and within the subterranean formation; and the first potential difference between the first and second points is created due to the electrical resistance of at least one of the subterranean formation and the casing. In an exemplary embodiment, the second point is radially and/or axially spaced from the first point; and the electrical current flows out of the casing radially to create the first potential difference between the first and second points. In an exemplary embodiment, inducing the electrical current to flow into the casing includes providing a second potential difference between the casing and a current return unit; and inducing the electrical current to flow through a first electrode, the first electrode extending within the interior of the casing and operably engaging the casing at a current injection point; wherein the electrical current flows through the first electrode and into the casing at the current injection point. In an exemplary embodiment, providing the second potential difference between the casing and the current return unit includes placing a power source in electrical communication with the casing via the first electrode, and in electrical communication with the current return unit via a second electrode; wherein the electrical current flows out of the casing and to the current return unit via at least the subterranean formation; and wherein the electrical current flows from the current return unit and to the power source via at least the second electrode. In an exemplary embodiment, utilizing the first potential difference to store the electrical power includes positioning a power harvester behind the casing and between the first and second points so that the power harvester is: in electrical communication with the downhole component; and configured to utilize the first potential difference to store the electrical power; and storing the electrical power in the power harvester. In an exemplary embodiment, supplying the stored electrical power to the downhole component includes delivering the stored electrical power to the downhole component from the power harvester. In an exemplary embodiment, permitting the electrical current to flow out of the casing to create the first potential difference includes permitting the electrical current to flow radially out of the casing and into the subterranean formation. In an exemplary embodiment, permitting the electrical current to flow radially out of the casing and into the subterranean formation includes selectively insulating the casing to control the location(s) along the casing where the electrical current is permitted to flow radially out of the casing and into the subterranean formation. In an exemplary embodiment, to create the first potential difference between the first and second points, the electrical current in the casing induces a magnetic flux in a toroid encircling the casing, the first and second points being located at first and second terminals, respectively, of the toroid.

The present disclosure also introduces a system for powering a downhole component positioned behind a casing, the casing extending within a wellbore that traverses a subterranean formation, the system including a power source in electrical communication with the casing; a power harvester positioned behind the casing and in electrical communication with the downhole component; and a current return unit in electrical communication with the power source; wherein at least the power source, the casing, the subterranean formation, and the current return unit form a circuit through which an electrical current flows; wherein flow of the electrical current out of the casing creates a potential difference behind the casing; wherein the potential difference behind the casing is utilized by the power harvester to store electrical power; and wherein the power harvester delivers the stored electrical power to the downhole component to thereby power the downhole component. In an exemplary embodiment, the potential difference is created between first and second points; the first and second points are located behind the casing; the second point is radially and/or axially spaced from the first point; and the electrical current flows out of the casing radially to create the potential difference between the first and second points. In an exemplary embodiment, the downhole component is positioned behind the casing and within the subterranean formation; the power harvester is positioned behind the casing and within the subterranean formation; the first and second points are located behind the casing and within the subterranean formation; and the potential difference between the first and second points is created due to the electrical resistance of at least one of the subterranean formation and the casing. In an exemplary embodiment, the system further includes a first electrode extending into the interior of the casing and operably engaging the casing at a current injection point, wherein the power source is in electrical communication with the casing via at least the first electrode; and a second electrode extending between the current return unit and the power source, wherein the current return unit is in electrical communication with the power source via at least the second electrode; wherein at least the power source, the first electrode, the casing, the subterranean formation, the current return unit, and the second electrode form the circuit through which the electrical current flows. In an exemplary embodiment, the system further includes a first toroid encircling the casing, the first toroid including first and second terminals between which the potential difference is created, wherein, to create the potential difference between the first and second terminals, the electrical current in the casing induces a magnetic flux in the first toroid. In an exemplary embodiment, the system further includes a second toroid encircling the casing and axially spaced from the first toroid, the second toroid including third and fourth terminals between which another potential difference is created, wherein, to create the other potential difference between the third and fourth terminals, the electrical current in the casing induces another magnetic flux in the second toroid.

The present disclosure also introduces a system for powering a downhole component positioned behind a casing, the casing extending within a wellbore that traverses a subterranean formation, the system including a power source to create a first potential difference and induce flow of an electrical current into the subterranean formation; a power harvester to store electrical power for delivery to the downhole component as a result of the flow of the electrical current into the subterranean formation; and a current return unit to receive the electrical current from the subterranean formation; wherein, when the first potential difference is created, the flow of the electrical current into the subterranean formation is induced, and the current return unit receives the electrical current from the subterranean formation: a circuit through which the electrical current flows is formed, the circuit including the power source, the casing, the subterranean formation, and the current return unit; the electrical current flows out of the casing to create a second potential difference that is utilized by the power harvester to store the electrical power; and the power harvester delivers the stored electrical power to the downhole component to thereby power the downhole component. In an exemplary embodiment, the second potential difference is created between first and second points; the first and second points are located behind the casing; the second point is radially and/or axially spaced from the first point; and the electrical current flows out of the casing radially to create the potential difference between the first and second points. In an exemplary embodiment, the system further includes a first electrode to extend into the interior of the casing and operably engage the casing at a current injection point; and a second electrode to extend between the current return unit and the power source; wherein the circuit through which the electrical current flows includes the power source, the first electrode, the casing, the subterranean formation, the current return unit, and the second electrode. In an exemplary embodiment, the system further includes a toroid to encircle the casing, the toroid including first and second terminals; wherein the second potential difference is created between the first and second terminals when the first potential difference is created, the flow of the electrical current into the subterranean formation is induced, and the current return unit receives the electrical current from the subterranean formation; and wherein, to create the second potential difference between the first and second terminals, the electrical current in the casing induces a magnetic flux in the toroid.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes, and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A method of powering a downhole component positioned behind a casing, the casing extending within a wellbore that traverses a subterranean formation, the method comprising:

inducing an electrical current to flow in the casing;

permitting the electrical current to flow out of the casing to create a first potential difference between a first point and a second point spaced therefrom, the first and second points being located exterior to the casing;

utilizing the first potential difference to store electrical power; and supplying the stored electrical power to the downhole component positioned behind the casing to thereby power the downhole component;

wherein the second point is radially spaced from the first point; and wherein the electrical current flows out of the casing substantially radially to create the first potential difference between the first and second points.

2. The method of claim 1, wherein the downhole component is positioned behind the casing and within the subterranean formation;

wherein the first and second points are located behind the casing and within the subterranean formation; and wherein the first potential difference between the first and second points is created due to the electrical resistance of at least one of the subterranean formation and the casing.

3. The method of claim 1, wherein inducing the electrical current to flow into the casing comprises:

providing a second potential difference between the casing and a current return unit; and inducing the electrical current to flow through a first electrode, the first electrode extending within the interior of the casing and operably engaging the casing at a current injection point;

wherein the electrical current flows through the first electrode and into the casing at the current injection point.

4. The method of claim 3, wherein providing the second potential difference between the casing and the current return unit comprises placing a power source in electrical communication with the casing via the first electrode, and in electrical communication with the current return unit via a second electrode;

wherein the electrical current flows out of the casing and to the current return unit via at least the subterranean formation; and wherein the electrical current flows from the current return unit and to the power source via at least the second electrode.

5. The method of claim 1, wherein utilizing the first potential difference to store the electrical power comprises:

positioning a power harvester behind the casing and between the first and second points so that the power harvester is:

in electrical communication with the downhole component; and configured to utilize the first potential difference to store the electrical power; and storing the electrical power in the power harvester.

6. The method of claim 5, wherein supplying the stored electrical power to the downhole component comprises delivering the stored electrical power to the downhole component from the power harvester.

7. The method of claim 1, wherein permitting the electrical current to flow out of the casing to create the first potential difference comprises permitting the electrical current to flow radially out of the casing and into the subterranean formation.

8. The method of claim 7, wherein permitting the electrical current to flow radially out of the casing and into the subterranean formation comprises selectively insulating the casing to control the location(s) along the casing where the electrical current is permitted to flow radially out of the casing and into the subterranean formation.

9. The method of claim 8, wherein selectively insulating the casing comprises applying a resistive cement or casing paint to portions of the casing.

10. The method of claim 1, further comprising inducing a magnetic flux in a toroid encircling the casing with the electrical current in the casing to create a second potential difference between first and second terminals, respectively, of the toroid.

11. A system for powering a downhole component positioned behind a casing, the casing extending within a wellbore that traverses a subterranean formation, the system comprising:

a power source in electrical communication with the casing;

a power harvester positioned behind the casing and in electrical communication with the downhole component; and a current return unit in electrical communication with the power source;

wherein at least the power source, the casing, the subterranean formation, and the current return unit form a circuit through which an electrical current flows;

wherein flow of the electrical current out of the casing creates a potential difference behind the casing;

wherein the potential difference behind the casing is utilized by the power harvester to store electrical power;

wherein the power harvester delivers the stored electrical power to the downhole component to thereby power the downhole component;

wherein the potential difference is created between first and second points;

wherein the first and second points are located exterior to the casing;

wherein the second point is radially spaced from the first point; and wherein the electrical current flows out of the casing substantially radially to create the potential difference between the first and second points.

12. The system of claim 11, wherein the downhole component is positioned behind the casing and within the subterranean formation;

wherein the power harvester is positioned behind the casing and within the subterranean formation;

wherein the first and second points are located behind the casing and within the subterranean formation; and wherein the potential difference between the first and second points is created due to the electrical resistance of at least one of the subterranean formation and the casing.

13. The system of claim 11, further comprising:

a first electrode extending into the interior of the casing and operably engaging the casing at a current injection point, wherein the power source is in electrical communication with the casing via at least the first electrode; and a second electrode extending between the current return unit and the power source, wherein the current return unit is in electrical communication with the power source via at least the second electrode;

wherein at least the power source, the first electrode, the casing, the subterranean formation, the current return unit, and the second electrode form the circuit through which the electrical current flows.

14. The system of claim 11, further comprising a first toroid encircling the casing, the first toroid comprising first and second terminals between which the potential difference is created, wherein, to create the potential difference between the first and second terminals, the electrical current in the casing induces a magnetic flux in the first toroid.

15. The system of claim 14, further comprising a second toroid encircling the casing and axially spaced from the first toroid, the second toroid comprising third and fourth terminals between which another potential difference is created, wherein, to create the other potential difference between the third and fourth terminals, the electrical current in the casing induces another magnetic flux in the second toroid.

16. The system of claim 11, further comprising resistive cement or casing paint applied to portions of the casing to selectively insulate the casing to control the location(s) along the casing where the electrical current is permitted to flow radially out of the casing and into the subterranean formation.

17. A system for powering a downhole component positioned behind a casing, the casing extending within a wellbore that traverses a subterranean formation, the system comprising:

a power source to create a first potential difference and induce flow of an electrical current into the subterranean formation;

a power harvester to store electrical power for delivery to the downhole component as a result of the flow of the electrical current into the subterranean formation; and a current return unit to receive the electrical current from the subterranean formation;

wherein, when the first potential difference is created, the flow of the electrical current into the subterranean formation is induced, and the current return unit receives the electrical current from the subterranean formation:

a circuit through which the electrical current flows is formed, the circuit comprising the power source, the casing, the subterranean formation, and the current return unit;

the electrical current flows out of the casing to create a second potential difference that is utilized by the power harvester to store the electrical power; and the power harvester delivers the stored electrical power to the downhole component to thereby power the downhole component;

wherein the second potential difference is created between first and second points;

wherein the first and second points are located exterior to the casing;

wherein the second point is radially spaced from the first point; and wherein the electrical current flows out of the casing radially to create the potential difference between the first and second points.

18. The system of claim 17, further comprising:

a first electrode to extend into the interior of the casing and operably engage the casing at a current injection point; and a second electrode to extend between the current return unit and the power source;

wherein the circuit through which the electrical current flows comprises the power source, the first electrode, the casing, the subterranean formation, the current return unit, and the second electrode.

19. The system of claim 17, further comprising a toroid to encircle the casing, the toroid comprising first and second terminals;

wherein the second potential difference is created between the first and second terminals when the first potential difference is created, the flow of the electrical current into the subterranean formation is induced, and the current return unit receives the electrical current from the subterranean formation; and wherein, to create a third potential difference between the first and second terminals, the electrical current in the casing induces a magnetic flux in the toroid.

20. The system of claim 17, further comprising resistive cement or casing paint applied to portions of the casing to selectively insulate the casing to control the location(s) along the casing where the electrical current is permitted to flow radially out of the casing and into the subterranean formation.

* * * * *